US005388722A

United States Patent [19]

Kageyama

[11] Patent Number: 5,388,722

[45] Date of Patent: Feb. 14, 1995

[54] STICK-SHAPED OBJECT DISPENSER

[75] Inventor: Hidehei Kageyama, Kawagoe, Japan

[73] Assignee: Kotobuki & Co., Ltd., Kyoto, Japan

[21] Appl. No.: 168,200

[22] Filed: Dec. 17, 1993

[30] Foreign Application Priority Data

Jul. 30, 1993 [JP] Japan ..... 5-049697[U]

[51] Int. Cl.[6] ..... B65D 83/00

[52] U.S. Cl. ..... 221/186; 221/190; 221/289

[58] Field of Search ..... 221/186, 188, 189, 288, 221/289, 303, 254, 263, 264

[56] References Cited

U.S. PATENT DOCUMENTS

| | | | |
|---|---|---|---|
| 582,458 | 5/1897 | Cotterill | 221/186 |
| 680,612 | 8/1901 | Parker | 221/254 |
| 1,043,628 | 11/1912 | Ross | 221/186 |
| 2,070,139 | 2/1937 | Metzgus | 221/188 |
| 2,434,257 | 1/1948 | Burch | 221/264 |
| 2,708,053 | 5/1955 | Berger et al. | 221/264 |
| 4,127,219 | 11/1978 | Mabus | 221/303 |
| 4,275,819 | 6/1981 | Perez | 221/186 |
| 4,282,990 | 8/1981 | Miyashita | 221/288 |
| 4,492,316 | 1/1985 | Emms | 221/264 |
| 4,723,531 | 2/1988 | Hampton | 221/288 |

FOREIGN PATENT DOCUMENTS 61-34155 10/1986 Japan .

*Primary Examiner*—H. Grant Skaggs

*Attorney, Agent, or Firm*—Rothwell, Figg, Ernst & Kurz

[57] ABSTRACT

A stick dispenser for containing sticks, such as spare leads for mechanical pencils or toothsticks comprises an outer case member (1) having an open rear end, and a front wall provided with a first outlet hole (3) through which the sticks are fed out one at a time, and an inner case member (2) slidably inserted in the outer case member (1) through the open rear end of the latter, provided with a cavity (6) for containing the sticks, and having a front wall provided with a second outlet hole (7). Normally, the inner case member (2) is biased toward one side wall of the outer case member (1) so that the second outlet hole (7) is out of alignment with the first outlet hole (3) to prevent the sticks from slipping out of the stick dispenser. When the inner case member (2) is depressed at a projection (10) formed on the outer surface of one of the side walls thereof or when the inner case member (2) is further pushed into the outer casing member (1), the second outlet hole (7) is set in alignment with the first outlet hole (3) of the outer case member (1) to feed out the sticks through the first outlet hole (3) and the second outlet hole (7) one at a time.

8 Claims, 3 Drawing Sheets

STICK-SHAPED OBJECT DISPENSER

BACKGROUND OF THE INVENTION

1. Field of the Invention

The present invention relates to a stick-shaped object (hereinafter referred to as stick) dispenser for containing sticks, such as spare leads for mechanical pencils or toothsticks, and, more particularly, to a stick dispenser for containing sticks, capable of surely feeding out the stick contained therein at a touch.

2. Description of the Related Art

A known stick dispenser for containing sticks comprises a case body for containing sticks, and a cap put on the case body so as to be removable from the case body or to be moved between an open position and a closed position. When taking out the stick from the stick dispenser, the cap is removed from the outlet of the case body. Accordingly, it is difficult to take out the stick surely from the stick dispenser at a touch.

The applicant of the present patent application proposed previously a stick dispenser for containing sticks, capable of feeding out a desired number of sticks in Japanese Utility Model Publication No. 61-34155. This previously proposed stick dispenser comprises a cylindrical case body and a cap put on the case body. The cap is turned relative to the case body to take out a desired number of sticks. Since the cap must be turned through an angle to take out the stick, it is difficult to surely and readily take out the stick.

SUMMARY OF THE INVENTION

Accordingly, it is an object of the present invention to provide a stick dispenser for containing sticks, such as spare leads for mechanical pencils or toothsticks capable of surely feeding out the sticks contained therein at a touch.

In one aspect of the present invention, a stick dispenser for containing sticks comprises an outer case member having one open end, and an inner case member slidably inserted in the outer case member through the open end of the latter. The outer case member has a front wall provided with a first outlet hole that allows only one stick to pass at a time and a positioning projection on its inner surface. The inner case member has a stick containing part having a space for containing sticks and provided at its front end with a second outlet hole having an axis normally dislocated from the axis of the first outlet hole, and an elastically flexible part extending on one side of the front portion of the stick containing part so as to bias the inner case member away from one inner side surface of the outer case member. When the inner case member is moved axially forward relative to the outer case member, the positioning projection of the outer case member positions the inner case member, bending the elastically flexible part of the inner case member so that the second outlet hole of the inner case member is aligned with the first outlet hole of the outer case member.

The stick contained in the stick dispenser can be surely fed out from the stick dispenser simply by applying pressure to the rear end of the inner case member to push the inner case member further into the outer case member or simply by depressing a projection formed on the outer surface of one side wall of the inner case member so as to be exposed in an opening formed in one side wall of the outer case member to position the second outlet hole of the inner case member into alignment with the first outlet hole of the outer case member.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
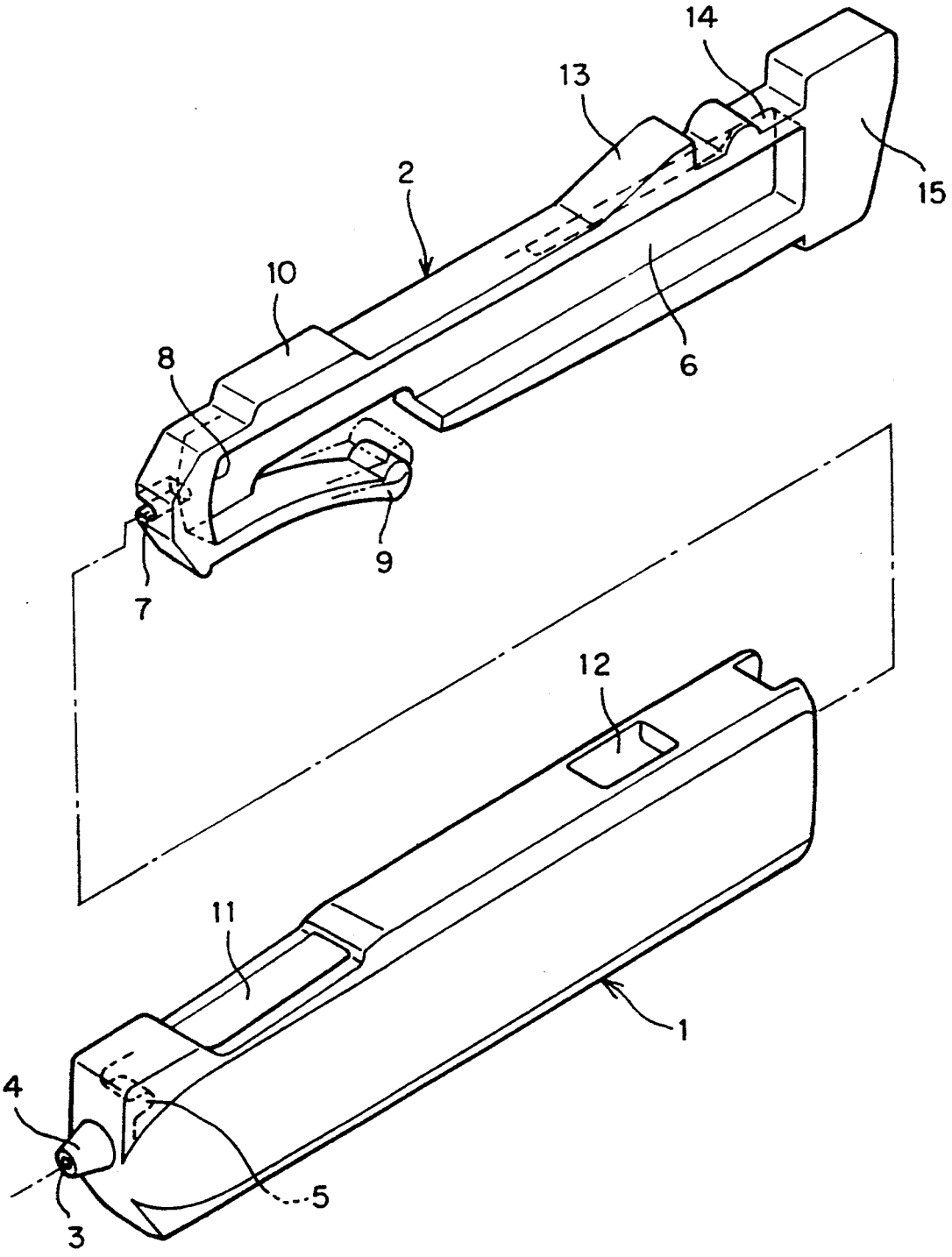
FIG. 1 is an exploded perspective view of a stick dispenser in a preferred embodiment according to the present invention.
Figure 2A:
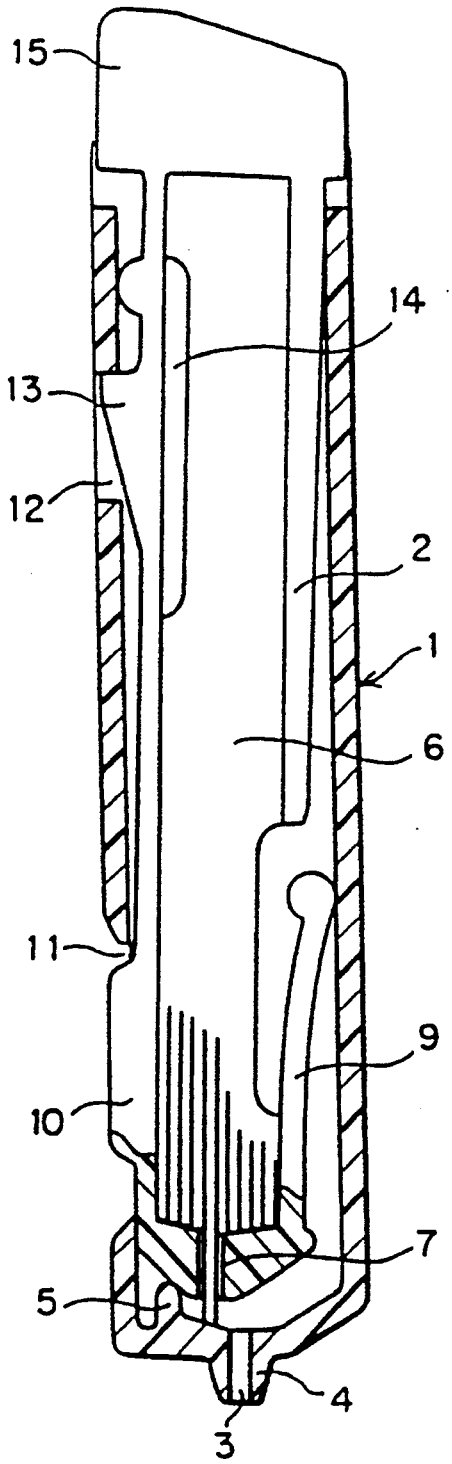
FIGS. 2(*a*) and 2(*b*) are longitudinal sectional views of the stick dispenser of FIG. 1 in different states.
Figure 2B:
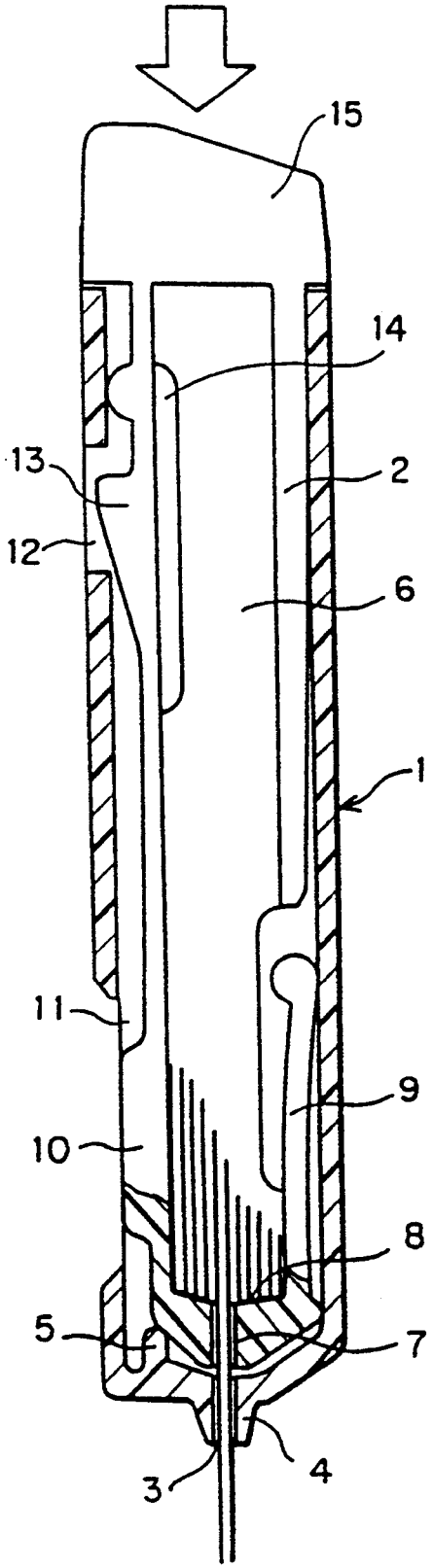
Figure 3:
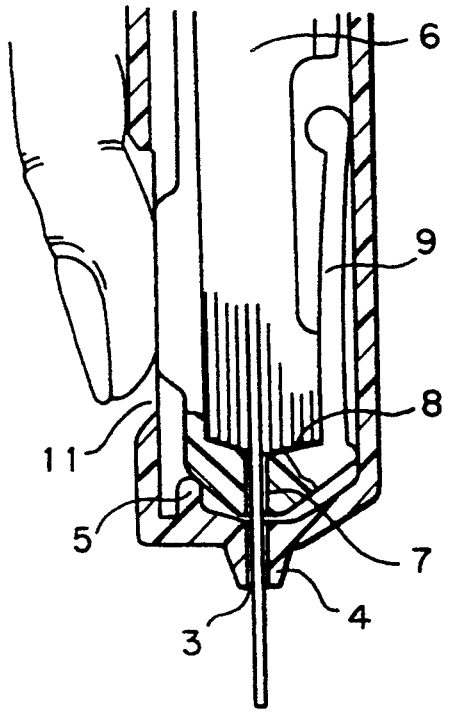
FIG. 3 is a fragmentary longitudinal sectional view of assistance in explaining a procedure of feeding out a stick.

Referring to FIGS. 1 to 3, a stick dispenser in a preferred embodiment according to the present invention comprises an outer case member 1 and an inner case member 2. The outer case member 1 is formed of a transparent plastic in an elongate shape. The outer case member 1 has an open rear end through which the inner case member 2 is inserted therein. A first outlet hole 3 that allows one stick to pass at a time is formed through the front wall of the outer case member 1 and through a guide projection 4 formed on the outer surface of the front wall of the outer case member 1. A positioning projection 5 is formed on the inner surface of the front wall of the outer case member 1.

The inner case member 2 is formed of a plastic in an elongate shape capable of being fitted in the outer case member 1. An elongate cavity 6 is formed in one side surface of the inner case member 2 to contain sticks therein. A second outlet hole 7 is formed through the front wall of the inner case member 2. The inner surface of the front wall of the inner case member 2 is formed in a tapered surface 8 tapering toward the second outlet hole 7. A front portion of the lower wall, as viewed in FIG. 1, of the cavity 6 is extended obliquely downward from the front end of the cavity 6 to form an elastically flexible tongue 9, which biases the inner case member 2 away from the lower wall of the outer case member 1 when the inner case member 2 is inserted in the outer case member 1 so that the second outlet hole 7 is dislocated from a stick feeding position where the second outlet hole 7 is aligned with the first outlet opening 3. In this state, the sticks contained in the cavity 6 of the inner case member 2 are prevented from slipping out of the stick dispenser through the first outlet hole 3 by the front wall of the outer case member 1.

A projection 10 is formed in the front portion of the inner case member 2 on the outer surface of the upper wall of the cavity 6, and a stopper projection 13 having a slope declining forward is formed in the rear portion of the inner case member 2 on the outer surface of the upper wall of the cavity 6. A through hole 11 is formed in the upper wall of the outer case member 1 at a position corresponding to the projection 10 of the inner case member 2. A through hole 12 is formed in the rear portion of the upper wall of the outer case member 1 so as to correspond to the stopper projection 13 of the inner case member 2. A longitudinal slot 14 is formed in the upper wall of the cavity 6 so as to extend under the stopper projection 13 to enable the stopper projection 13 to be bent easily toward the cavity 6. The inner case member 2 is provided at its rear end with a knob 15.

Figure 4:
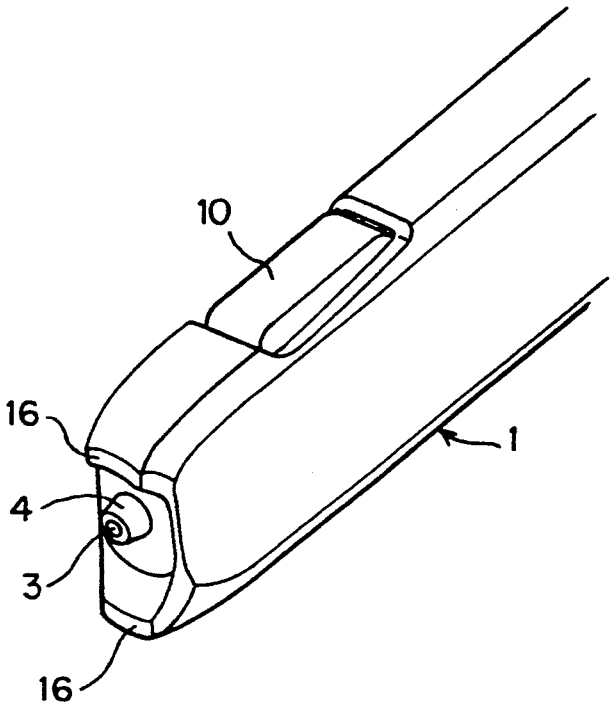
FIG. 4 is a fragmentary perspective view of a modification of the stick dispenser of FIG. 1.

Referring to FIG. 4, another stick dispenser in a modification of the foregoing stick dispenser shown in FIGS. 1 to 3 has an outer case member 1 having a front wall provided on its front surface with a pair of projective protrusions 16 respectively on the opposite sides of a guide projection 4 to protect the guide projection 4 from being damaged.

When assembling the outer case member 1 and the inner case member 2, the inner case member 2 is placed with the cavity 6 facing up and a predetermined number of sticks are put in the cavity 6, and then the inner case member 2 is fitted in the outer case member 1 by applying axial pressure to the knob 15 so that the outer case member 1 and the inner case member 2 are nested in a state as shown in FIG. 2(*a*). In the state shown in FIG. 2(*a*), the inner case member 2 is biased away from the lower wall of the outer case member 1 by the resilience of the elastically flexible tongue 9 so that the second outlet hole 7 of the inner case member 2 is out of alignment with the first outlet hole 3 of the outer case member 1, so that the sticks are unable to slip out of the stick dispenser.

When feeding out the sticks from the stick dispenser, the stick dispenser is held in a vertical position with the open rear end of the outer case member 1 facing up, and downward pressure is applied to the knob 15. Consequently, the front end of the inner case member 2 comes into contact with the positioning projection 5 of the outer case member 1 and is caused to move toward the lower wall of the outer case member 1, and the second outlet hole 7 of the inner case member 2 is positioned in alignment with the first outlet hole 3 of the outer case member 1 as shown in FIG. 2(*b*). In this state, the sticks are able to fall through the second outlet hole 7 and the first outlet hole 3 out of the stick dispenser one at a time. It is also possible to position the second outlet hole 7 in alignment with the first outlet hole 3 by depressing the projection 10 exposed in the through hole 11 of the outer case member 1 instead of applying downward pressure to the knob 15. When the projection 10 is depressed, the elastically flexible tongue 9 is bent forcibly and the inner case member 2 is set in parallel with the outer case member 1 so that the second outlet hole 7 is positioned in alignment with the first outlet hole 3.

When the downward pressure is removed from the knob 15 or when the projection 10 is released, the inner case member 2 is returned to its initial position shown in FIG. 2(*a*) by the resilience of the elastically flexible tongue 9 and, consequently, the second outlet hole 7 is set out of alignment with the first outlet hole 3 to prevent the sticks from slipping out of the stick dispenser. The knob 15 or the projection 10 is depressed repeatedly to feed out a plurality of sticks.

The rear end of stopper projection 13 of the inner case member 2 engages the rear edge of the through hole 12 of the outer case member 1 corresponding to the stopper projection 13 to prevent the inner case member 2 from slipping out of the outer case member 1. Therefore, the inner case member 2 will not fall out of the outer case member 1 to scatter the sticks contained therein.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A stick-shaped object dispenser for dispensing stick-shaped objects, comprising:

an outer case member having an open rear end, and a front wall provided with a first outlet hole through which the stick-shaped objects are fed out; and an inner case member removably and slidably inserted in the outer case member through the open rear end of the latter, provided with an elongated cavity for containing the stick-shaped objects formed in a side surface thereof and having a front wall provided with a second outlet hole through which the stick-shaped objects are fed out, said inner case member being removed from said outer case member through said open rear end in order to load a plurality of stick-shaped objects into said cavity;

characterized in that a front portion of a side wall of the cavity of the inner case member contiguous with the front wall thereof is bent obliquely outward to form an elastically flexible tongue which biases the front portion of the inner case member away from a side wall of the outer case member with which the extremity of the elastically flexible tongue is in contact, and the outer case member is provided with a positioning means for positioning the front portion of the inner case member against the resilience of the elastically flexible tongue so that the second outlet hole of the inner case member is set in alignment with the first outlet hole of the outer case member upon application of a predetermined force to said inner case member.

2. A stick-shaped object dispenser according to claim 1, wherein the positioning means of the outer case member is a positioning projection formed on the inner surface of the front wall of the outer case member.

3. A stick-shaped object dispenser according to claim 1, wherein a first through hole is formed in a side wall of the outer case member, and a projection is formed on a side wall of the inner case member, said projection protruding through said first through hole when said inner case member is inserted in said outer case member.

4. A stick-shaped object dispenser according to claim 3, wherein the outer case member is provided with a second through hole in one of the side walls thereof having a front edge and a rear edge, and the inner case member is provided with a stopper projection on the outer surface of one of the side walls thereof so as to be disposed in the second through hole of the outer case member and to engage a rear edge of the second through hole of the outer case member.

5. A stick-shaped object dispenser according to claim 4, wherein a slot is formed in the wall of the inner case member on which the stopper projection is formed so as to extend under the stopper projection.

6. A stick-shaped object dispenser according to claim 1, wherein the inner surface of the front wall of the inner case member is tapered toward the second outlet hole.

7. A stick-shaped object dispenser according to claim 1, wherein the outer case member is provided with a guide projection on the outer surface of the front wall thereof, the first outlet hole is formed through the guide projection, and protective protrusions are formed on the opposite sides of the guide projection on the outer surface of the front wall of the outer case member to protect the guide projection from being damaged.

8. A stick-shaped object dispenser for dispensing stick-shaped objects, comprising:

an outer case member having an open rear end and a front wall opposite said open rear end, said front wall including a first outlet hole through which said stick-shaped objects are dispensed; and an inner case member removably and slidably inserted into said outer case member through said open rear end thereof, said inner case member including a cavity for containing said stick-shaped objects, a front wall of said inner case member including a second outlet hole through which said stick-shaped objects are fed out;

said inner case member further including means for normally biasing said second outlet hole out of alignment with said first outlet hole so as to prevent said stick-shaped objects from being dispensed through said first outlet hole, first means for positioning said second outlet hole into alignment with said first outlet hole through application of force to said inner case member in a first direction, and second means for positioning said second outlet hole into alignment with said first outlet hole through application of force to said inner case member in a second direction different from said first direction;

whereby said stick-shaped objects may be dispensed through said first outlet hole through application of force to either of said first positioning means or said second positioning means.

* * * * *